US007836868B2

(12) United States Patent
Gonzalez et al.

(10) Patent No.: US 7,836,868 B2
(45) Date of Patent: Nov. 23, 2010

(54) BY-PASS VALVE

(75) Inventors: Carlos Manuel Castaño Gonzalez, Vigo-Pontevedra (ES); Xoán Xosé Hermida Domínguez, Pontevedra (ES); José Antonio Sanroman Prado, Vigo (ES)

(73) Assignee: Borgwarner Emissions Systems Spain, S.L., Vigo, Potevedra (ES)

( * ) Notice: Subject to any disclaimer, the term of this patent is extended or adjusted under 35 U.S.C. 154(b) by 317 days.

(21) Appl. No.: 11/815,651

(22) PCT Filed: Feb. 8, 2006

(86) PCT No.: PCT/EP2006/050780

§ 371 (c)(1),
(2), (4) Date: Feb. 8, 2008

(87) PCT Pub. No.: WO2006/084867

PCT Pub. Date: Aug. 17, 2006

(65) Prior Publication Data

US 2008/0141657 A1 Jun. 19, 2008

(30) Foreign Application Priority Data

Feb. 8, 2005 (ES) ..... 200500253

(51) Int. Cl.
*F02M 25/07* (2006.01)
*F02B 47/08* (2006.01)
*F28F 27/02* (2006.01)

(52) U.S. Cl. ..... 123/568.12; 165/103

(58) Field of Classification Search ..... 123/58.8, 123/568.11, 568.12; 60/605.2; 165/103
See application file for complete search history.

(56) References Cited

U.S. PATENT DOCUMENTS

| | | | | |
|---|---|---|---|---|
| 5,732,688 | A * | 3/1998 | Charlton et al. | 123/568.12 |
| 6,718,956 | B2 * | 4/2004 | Klipfel et al. | 123/568.12 |
| 6,971,377 | B2 * | 12/2005 | Moyer et al. | 123/568.12 |
| 7,032,577 | B2 * | 4/2006 | Rosin et al. | 123/568.12 |
| 7,198,037 | B2 * | 4/2007 | Sayers et al. | 123/568.12 |

FOREIGN PATENT DOCUMENTS

| | | | | |
|---|---|---|---|---|
| EP | 0971427 | | 1/2000 | |
| EP | 1291509 | | 3/2003 | |
| EP | 1355058 | | 10/2003 | |
| EP | 1491837 | | 12/2004 | |
| JP | 2003247459 | A * | 9/2003 | 123/568.12 |
| WO | 03/062625 | | 7/2003 | |
| WO | 03/085252 | | 10/2003 | |
| WO | 2006/029700 | | 3/2006 | |

* cited by examiner

*Primary Examiner*—Willis R Wolfe, Jr.
(74) *Attorney, Agent, or Firm*—Fish & Richardson P.C.

(57) ABSTRACT

A by-pass valve to regulate the passage of a gas towards two areas of a device, comprising a body coupled to said device, with an internal chamber in which the inlet gas is received through an inlet pipe, and two outlet pipes directed towards said areas and having a planar face with an access opening to its internal chamber through which there is inserted a planar plate on which the closing member and its actuation means are assembled, the closing member being duly positioned so as to close the outlet pipes.

6 Claims, 5 Drawing Sheets

BY-PASS VALVE

CROSS REFERENCE TO PRIOR APPLICATION

This application is the U.S. national phase of International Application No. PCT/EP2006/050780, filed Feb. 8, 2006, which claims priority from Spanish Patent Application No. P200500253, filed Feb. 8, 2005. The disclosures of both applications are incorporated herein by reference in their entirety. The International Application published in English on Aug. 17, 2006 as WO 2006/084867 A1 under PCT Article 21(2).

TECHNICAL FIELD

The present invention refers to a by-pass valve, and more specifically to a by-pass valve for a heat exchanger for an exhaust gas recirculation (EGR) system of an internal combustion engine.

BACKGROUND ART

In the current state of the art different exhaust gas recirculation systems in internal combustion engines, called EGR systems, are known.

These systems recirculate exhaust gases from the exhaust manifold to the intake manifold of the engine after subjecting them to a cooling process for the purpose of reducing the amount of NOx emissions.

As the cooling of the exhaust gases is not appropriate in certain operating conditions of the engine, the use of by-pass pipes has been proposed in the art, allowing the recirculation of exhaust gases without passing through the heat exchanger under the control of a valve channeling the exhaust gases either towards the heat exchanger or else towards said by-pass pipe, according to pre-established conditions.

Different proposals for inlet valves for heat exchangers with by-pass pipes are known, such as those disclosed in patent EP 0971 427 B1 and in patent applications WO 03/085252 A2, WO 03/062625 A1, EP 1 291 509 A2 and EP 1 355 058 A2, which have several drawbacks which the present invention aims to solve.

DISCLOSURE OF INVENTION

The present invention proposes a by-pass valve to regulate the passage of a gas towards a device with two gas flow areas, such as an EGR system heat exchanger with an integrated by-pass pipe in which the inlet gas must flow either through the cooling module or else through the by-pass pipe, or such as a two-passage EGR system heat exchanger in which the inlet gas must pass either through the cooling module or else through the exhaust pipe towards the intake manifold of the engine.

The body of the valve, which is coupled to the device, has an internal chamber in which the inlet gas is received through an inlet pipe, and two outlet pipes directed towards the two gas passage areas and a planar face with an access opening to its internal chamber.

The moving members of the valve, i.e. the closing member of the outlet pipes assembled on a rotating pin, and their corresponding drive means are assembled on a planar plate such that they can "be inserted" as an assembly in the body of the valve by fixing the planar plate to the planar face of the body of the valve by means of screws, for example.

A first feature of the valve object of the present invention is that it allows the possibility of independent manufacture of the body of the valve and of the assembly of its moving members.

This independence allows a standardization of the moving members assembly of the valve, apart from the device for which it is intended, in which it is only necessary to take into account that the body of the valve must be configured such that it allows the "insertion" of the plate with the moving members assembly.

A second feature of the valve object of the present invention is that it allows use thereof in different types of EGR system heat exchangers, and particularly in exchangers with single gas passage or double gas passage cooling modules.

A third feature of the valve object of the present invention is that it allows reducing the angle of rotation between the close position of each outlet pipe.

A fourth feature of the vale object of the present invention is that it requires neither casting nor complicated mechanized parts, which allows a simple manufacturing process with a small number of components.

A fifth feature of the valve object of the present invention is that not only is it applicable to EGR system heat exchangers, but it can be used in other gas piping devices, and particularly in engine exhaust gas heat recovery devices.

Other features and advantages of the present invention will be understood from the following detailed description of an illustrative and by no means limiting embodiment of its object in relation with the enclosed drawings.

BEST MODE FOR CARRYING OUT THE INVENTION

Figure 1:
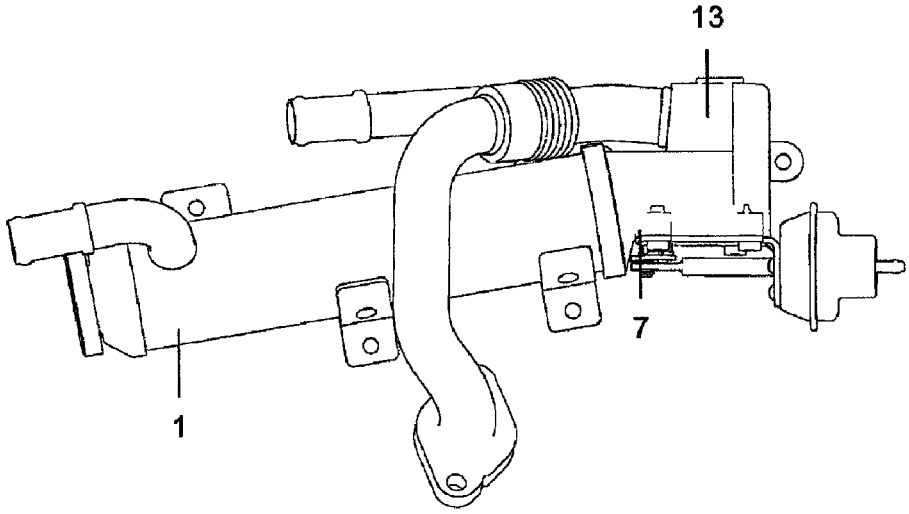
FIGS. 1, 2 and 3 show perspective views of an EGR system heat exchanger with an integrated by-pass pipe, with a by-pass valve according to the present invention from different positions.
Figure 2:
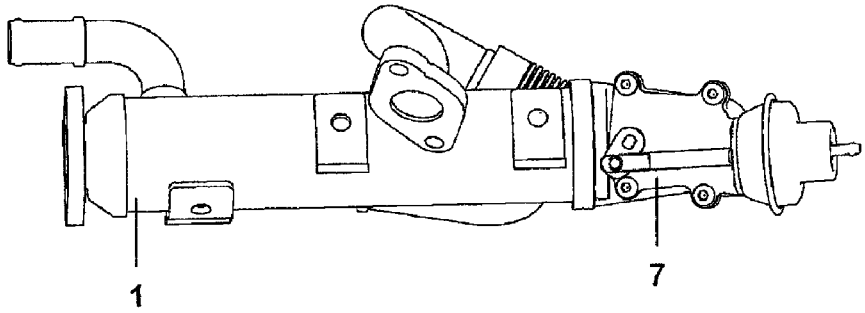
Figure 3:
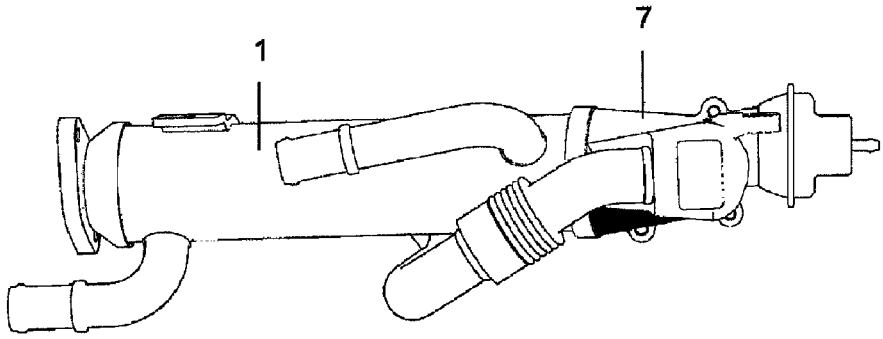
Figure 4:
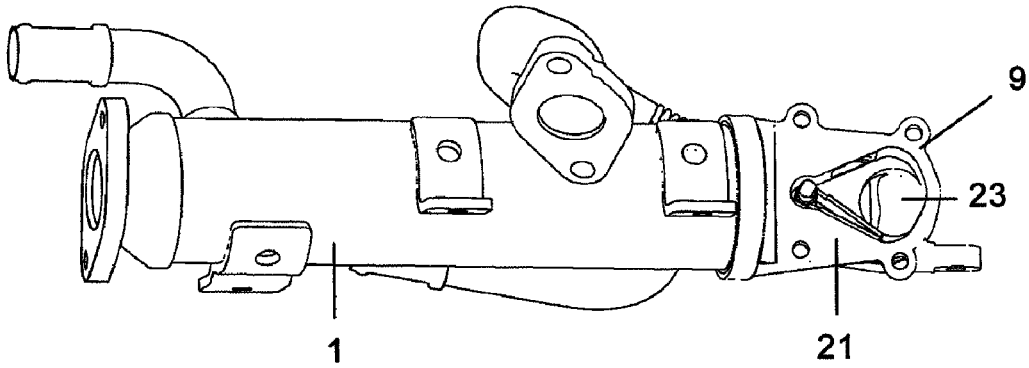
FIG. 4 shows a perspective view of an EGR system heat exchanger with an integrated by-pass pipe, with the body of a by-pass valve, showing the opening through which the moving parts assembly of the valve is inserted.
Figure 5:
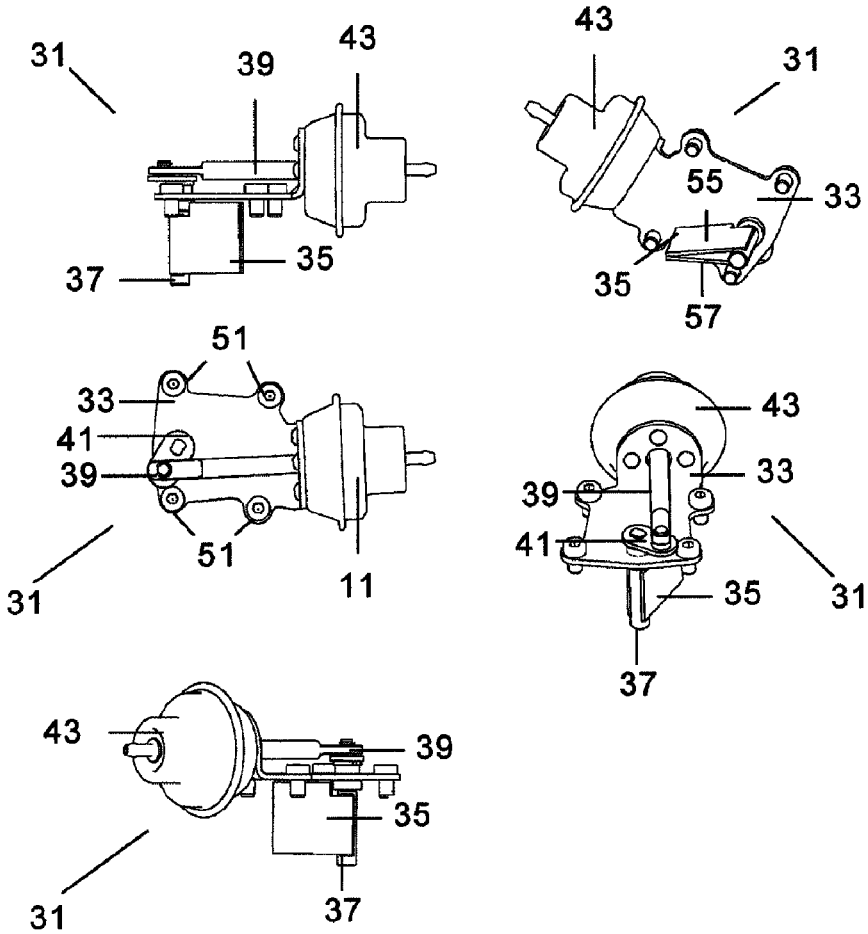
FIG. 5 shows different perspective views of the moving parts assembly of the valve which is inserted and fixed to the body of the valve.
Figure 6:
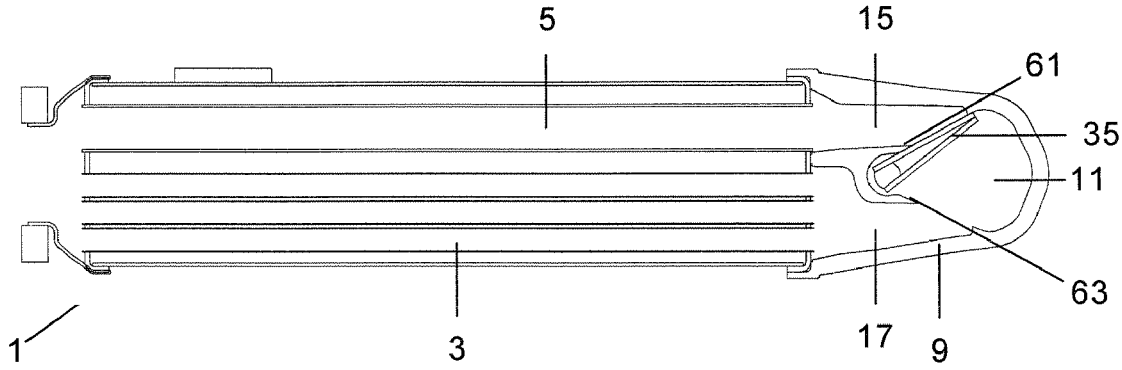
FIG. 6 shows a cross sectional view of an EGR system heat exchanger with an integrated by-pass pipe, with a by-pass valve according to the present invention.
Figure 7:
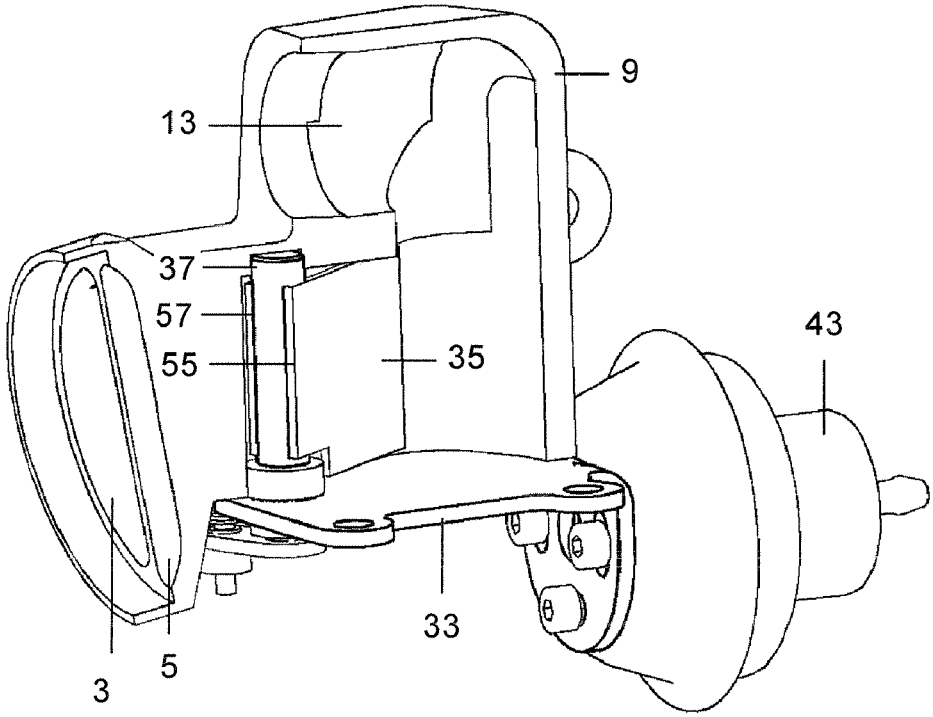
FIG. 7 shows a perspective view of the inside of a by-pass valve according to the present invention.
Figure 8:
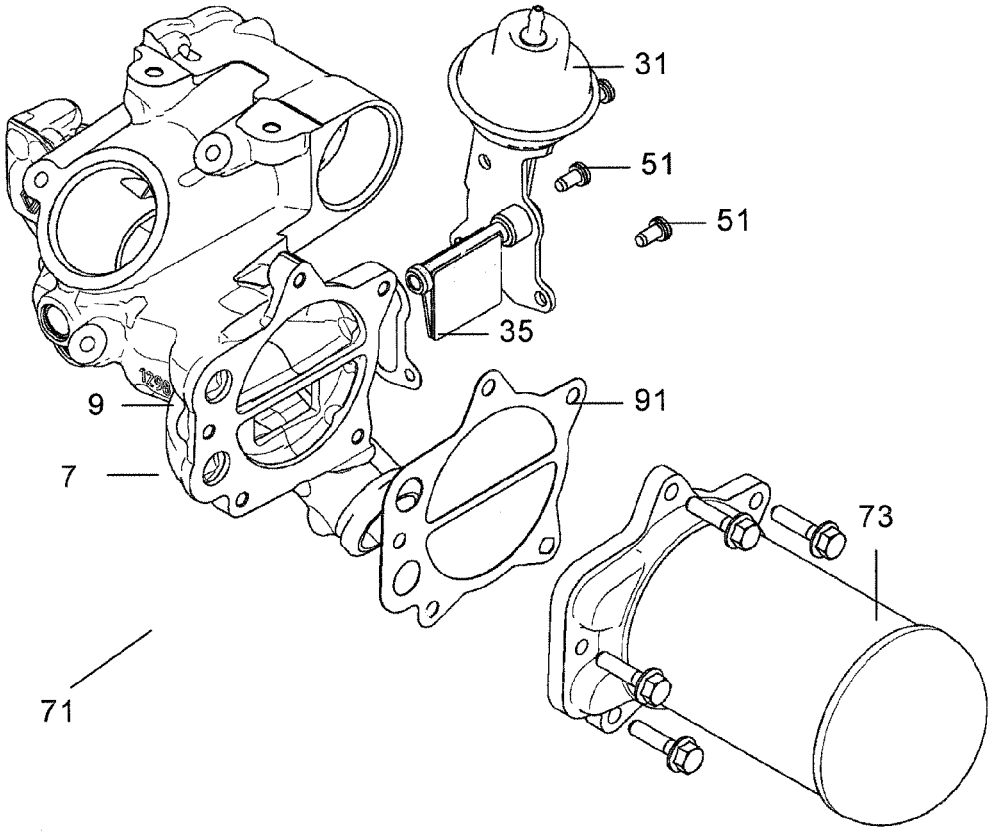
FIGS. 8 and 9 show perspective views of a two-passage EGR system heat exchanger with a by-pass valve according to the present invention from different positions.
Figure 9:
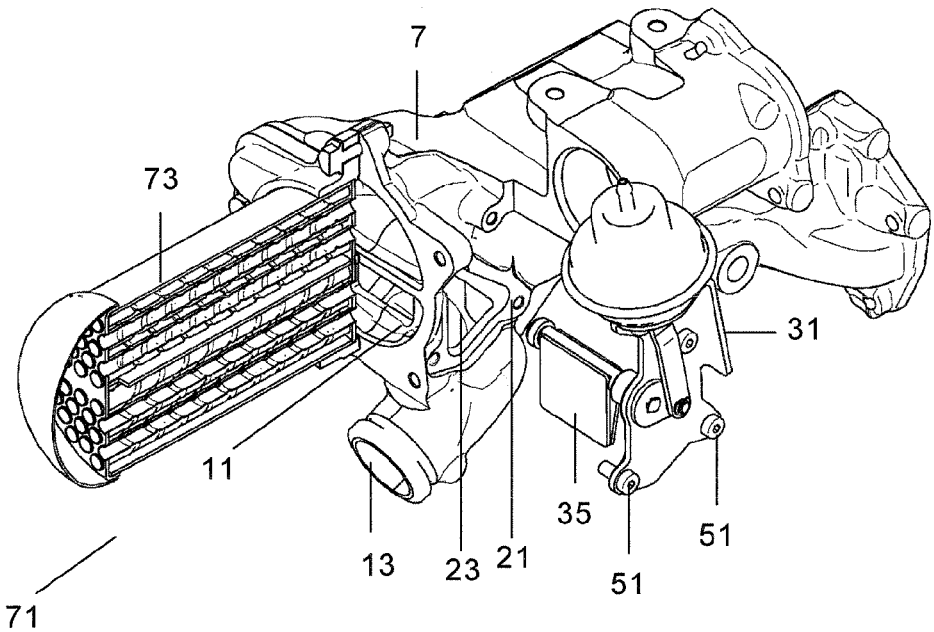

In the embodiment of the invention which will first be described in reference to FIGS. 1-7, the valve 7 according to the invention is coupled to a heat exchanger 1 for exhaust gases of an EGR system which internally houses a cooling module 3 formed by a set of interconnected pipes through which the gases which are to be cooled circulate, and a by-pass pipe 5 through which the exhaust gases which are not to be cooled circulate.

On one hand, the valve 7 comprises a body 9 with an internal chamber 11 in which the inlet gas is received through an inlet pipe 13, and two outlet pipes 15, 17 directed towards the cooling module 3 and the by-pass pipe 5 of the heat exchanger. The body 9 has a planar face 21 with an access opening 23 to its internal chamber 11.

On the other hand, the valve comprises the assembly 31 including the moving members of the valve assembled on a planar plate 33: the closing member 35 of the outlet pipes 15, 17 assembled on the pin 37, the connecting rod-crank device 39, 41 for making the pin 37 rotate, and the actuator 43, which can be pneumatic or electric.

The assembly 31 is fixed to the body 9 by means of screws 51, the closing member 35 being duly positioned so as to close the outlet pipes 15, 17.

In this embodiment, the body 9 of the valve can be manufactured as part of the exchanger 1, in stainless steel.

Secondly, an embodiment of the invention in reference to FIGS. 8-11 will be described, in which the valve 7 according to the invention is coupled to a heat exchanger 71 for exhaust gases of a two-passage EGR system for directing the inlet gas to be cooled either towards the cooling module 73 or else directly towards the exhaust pipe 75 towards the inlet manifold of the engine, if it is not to be cooled.

Figure 10:
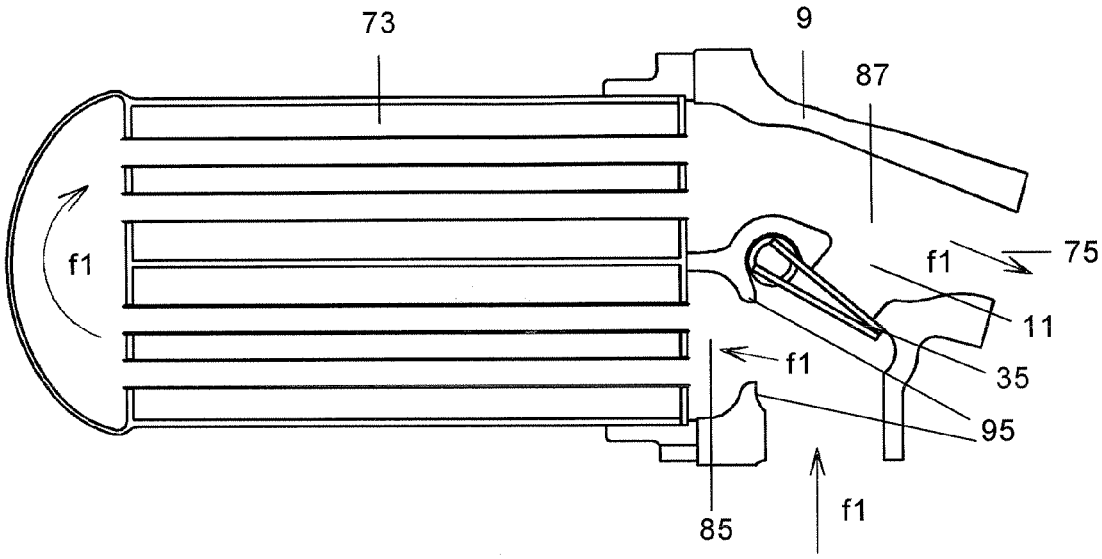
FIGS. 10 and 11 shows cross sectional views of a two-passage EGR system heat exchanger with a by-pass valve according to the present invention.
Figure 11:
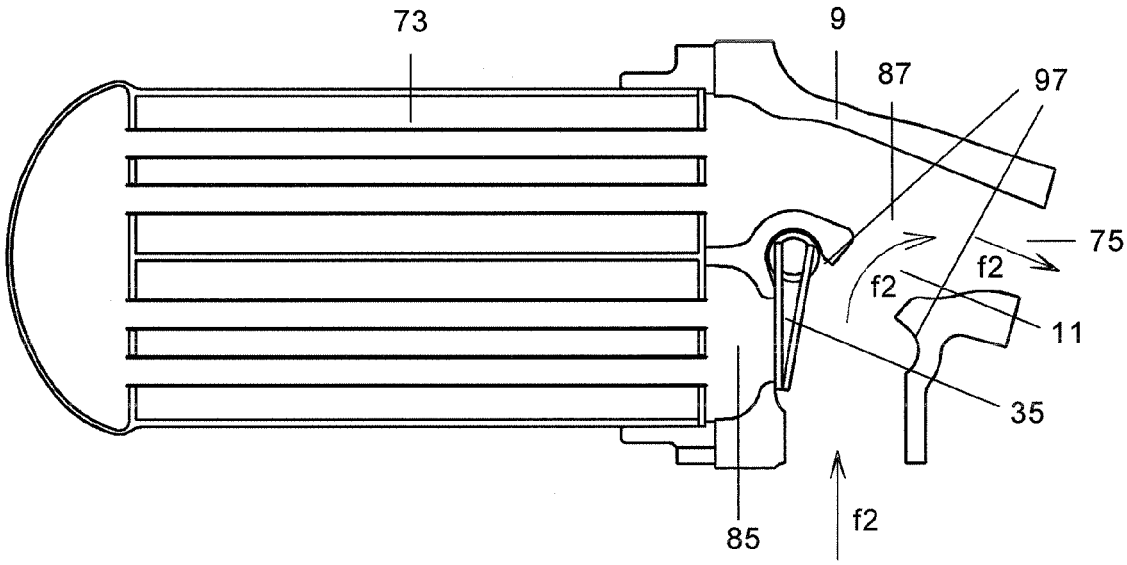

In the first case, the gas follows the path indicated by the arrows f1 in FIG. 10, and in the second case follows the path indicated by the arrows f2 in FIG. 11.

On one hand the valve 7 comprises a body 9 with an internal chamber 11 in which the inlet gas is received through an inlet pipe 13, and two outlet pipes 85, 87 directed, respectively, towards the cooling module 73 and the exhaust pipe 75 towards the intake manifold. The body 9 has a planar face 21 with an access opening 23 to its internal chamber 11.

On the other hand, the assembly 31 of moving members of the valve is similar to that of the previously described embodiment and is fixed to the body 9 by means of screws 51, the closing member 35 being duly positioned so as to close the outlet pipes 85, 87.

In this embodiment, the body 9 of the valve can be manufactured on an aluminum casting part independent from the exchanger 71, and both parts are coupled together using the intermediate flange 91.

In the preferred variant of the two described embodiments, which is the one shown in the figures, the closing member 35 is formed by a double blade, formed by two blades 55, 57 shaped in the manner of a triangular prism with the rotating pin 37 at its base.

Several manufacturing processes can be used for this: welding of the blades 55, 57 at one of their sides to the rotating pin 37 such that they are joined at the other side; manufacture of a single metal plate formed in a V-shape, the ends of which are joined to the pin 37; manufacture of the pin 37, blades 55, 57 assembly as a single part; manufacture of a casting part with a machining so as to obtain a single pin 37 and blades 55, 57 member.

The size of the blades 55, 57 of the double blade fixed to the rotating pin 37 (or of a single blade which will be used as the closing member 35 in an alternative embodiment) can be sized to be small enough and with a center of pressure very close to the rotating pin 37 (making the blade taller than it is wide) so that it performs well against the pressure pulsations occurring in the engine. These pressure pulsations introduce torques in the rotating pin 37 which tend to open the closing member during engine operation. With the mentioned configuration, this opening can be prevented using an actuator 43 of a smaller size than what would be necessary for those valves in which the area of the closing member 35 is greater or the center of pressure is farther from the rotating pin 37.

The body 9 of the valve is configured so that the beginning of the outlet pipes 15, 17; 85, 87 is configured by means of planar areas 61, 63; 95, 97 acting as a mechanical stop of the closing member 35, providing perfect control of its run and assuring a perfect closing preventing gas leaks through the pipe which is to be closed in each case.

The closing member 35 logically must have a larger size than the opening of the outlet pipes 15, 17; 85, 87 so that these openings are closed when the closing member 35 comes into contact with the planar areas 61, 63; 95, 97.

The high seal rating between the two circuits to which the valve provides access and the good performance against the pressure pulsations of the engine with an appropriate sizing of the closing member 35 enables the use of pneumatic actuators of smaller sizes than those which will be necessary in another type of by-pass valves which either do not have small closing members to withstand the pressure pulsations of the engine, or else do not have a high seal rating between the circuit carrying the gas to the cooling module and the circuit carrying the gas to the by-pass pipe.

The valve according to the invention allows reducing the angle of rotation demarcated between the planar areas 61, 63; 95, 97 which the closing member 35 must run in order to go from the working position in which the gas circulates towards the cooling module 3, 73 to the working position in which the gas circulates towards the pipe 5, 75, which has the advantage that the torque losses of the connecting rod-crank system are very small, whereby valves with angles of less than 45° can be obtained.

The valve object of the present invention also allows proportional control of the passage of gas towards the cooling module 3, 73 or towards the pipe 5, 75 if it is provided with an actuator which allows placing the closing member 35 in any intermediate location between the planar areas 61, 63; 95, 97 for closing the outlet pipes 15, 17; 85, 87.

The double blade 55, 57 used as a closing member 35 in the described embodiments has several advantages:

- It aids in the flow of gas from the inlet pipe 13 towards either of the two outlet pipes 15, 17; 85, 87, thus improving the pressure drop level introduced by the valve into the system.
- It contributes to preventing the accumulation of exhaust gas residues in the area around the rotating pin 37 since, because of its shape, it eliminates the space in which the exhaust gas remains can be deposited by virtue of the flow conditions existing in the valve.
- It contributes to reducing the angle of rotation of the blade 35.
- It functions as a thermal insulator, especially in the embodiment with the two-passage heat exchanger.
- The gas stream aids in closing the blade 35 over the planar areas 61, 95 or 63, 97, whichever are applicable in each case.

With respect to the described embodiments of the invention, those modifications comprised within the scope defined by the following claims can be introduced.

The invention claimed is:

1. A by-pass valve to regulate the flow of gas towards two areas of a device, comprising a body coupled to said device with an internal chamber in which the inlet gas is received through an inlet pipe, and two outlet pipes directed towards said areas, a closing member of said outlet pipes assembled on a rotating pin and actuation means of said closing member, wherein:

a) the body has a planar face with an access opening to its internal chamber; and b) said rotating pin with the closing member and its actuation means are assembled on a planar plate which is fixed to said planar face of the body, the closing member being duly positioned so as to close the outlet pipes when coming into contact with planar areas configured at the beginning portions of said pipes.

2. A by-pass valve according to claim 1, wherein the body is configured such that the outlet pipes can be closed by the closing member acting at a working angle of less than 45.degree.

3. A by-pass valve according to claim 1, wherein the closing member comprises two blades with a triangular prism shape, fixed at one of their sides to the rotating pin and joined to one another at the opposite side.

4. A by-pass valve according to claim 1, wherein the actuation means of the closing member include specific means which allow placing it in any intermediate position between the outlet pipes, enabling proportional control of the gas directed towards each one of them.

5. A by-pass valve according to claim 1, wherein the device to which it is coupled is an EGR system heat exchanger with an integrated by-pass pipe in which the two areas are the cooling module and the by-pass pipe.

6. A by-pass valve according to claim 1, wherein the device to which it is coupled is a two-passage EGR heat exchanger in which the two areas are the cooling module and the exhaust pipe leading to the intake manifold of the engine.

* * * * *

UNITED STATES PATENT AND TRADEMARK OFFICE

CERTIFICATE OF CORRECTION

PATENT NO. : 7,836,868 B2
APPLICATION NO. : 11/815651
DATED : November 23, 2010
INVENTOR(S) : Carlos Manuel Castano Gonzalez et al.

It is certified that error appears in the above-identified patent and that said Letters Patent is hereby corrected as shown below:

On the Title Page (73) Assignee – delete "Potevedra" and insert -- Pontevedra --

Signed and Sealed this
Twelfth Day of April, 2011

David J. Kappos

David J. Kappos
*Director of the United States Patent and Trademark Office*